US007856671B1

(12) United States Patent
Davis

(10) Patent No.: US 7,856,671 B1
(45) Date of Patent: Dec. 28, 2010

(54) CAP

(76) Inventor: Maricuis A. Davis, 1767 Gabbro Trail, Eagan, MN (US) 55122

( * ) Notice: Subject to any disclaimer, the term of this patent is extended or adjusted under 35 U.S.C. 154(b) by 392 days.

(21) Appl. No.: 12/051,566

(22) Filed: Mar. 19, 2008

Related U.S. Application Data

(63) Continuation-in-part of application No. 11/626,672, filed on Jan. 24, 2007, now abandoned.

(51) Int. Cl.
*A42B 1/24* (2006.01)

(52) U.S. Cl. ..... 2/209.13; 2/175.3; 2/209.4; 40/329

(58) Field of Classification Search ..... 2/209.13, 2/175.3, 209.4, 175.1, 195.1; 40/329
See application file for complete search history.

(56) References Cited

U.S. PATENT DOCUMENTS 1,640,895 A * 8/1927 Hills ..... 2/175.3
2,068,760 A * 1/1937 Olson ..... 2/175.3
2,106,570 A * 1/1938 Lipton ..... 2/175.3
2,226,133 A * 12/1940 Lee, Jr. ..... 2/175.3
3,206,766 A * 9/1965 Smith ..... 2/209.7
5,410,761 A 5/1995 Connelly et al.
5,437,062 A 8/1995 Douglas
5,509,144 A 4/1996 Soergel et al.
5,715,534 A 2/1998 Mobley
D405,239 S 2/1999 Kostinko
6,070,270 A 6/2000 De La Torre
6,553,577 B2 * 4/2003 Montague ..... 2/175.3

* cited by examiner

*Primary Examiner*—Gary L Welch
*Assistant Examiner*—Alissa J Tompkins

(57) ABSTRACT

A cap for providing a distinctive appearance for a person includes a head cover being positionable over a portion of a head of a person. A bill is coupled to the head cover and extends outwardly from the head cover to shade eyes of the person. A band is removably positioned on an exterior surface of the head cover. The band is positioned adjacent and coextensive with a bottom edge of the head cover. The band includes a loop portion and a single raised section spaced from the exterior surface. The band extends upwardly from the bottom edge of the head cover and above the bill. The raised portion is adjustable to adjust a length of the loop portion to frictionally engage the head cover. At least one decorative item is insertable through the raised section.

7 Claims, 3 Drawing Sheets

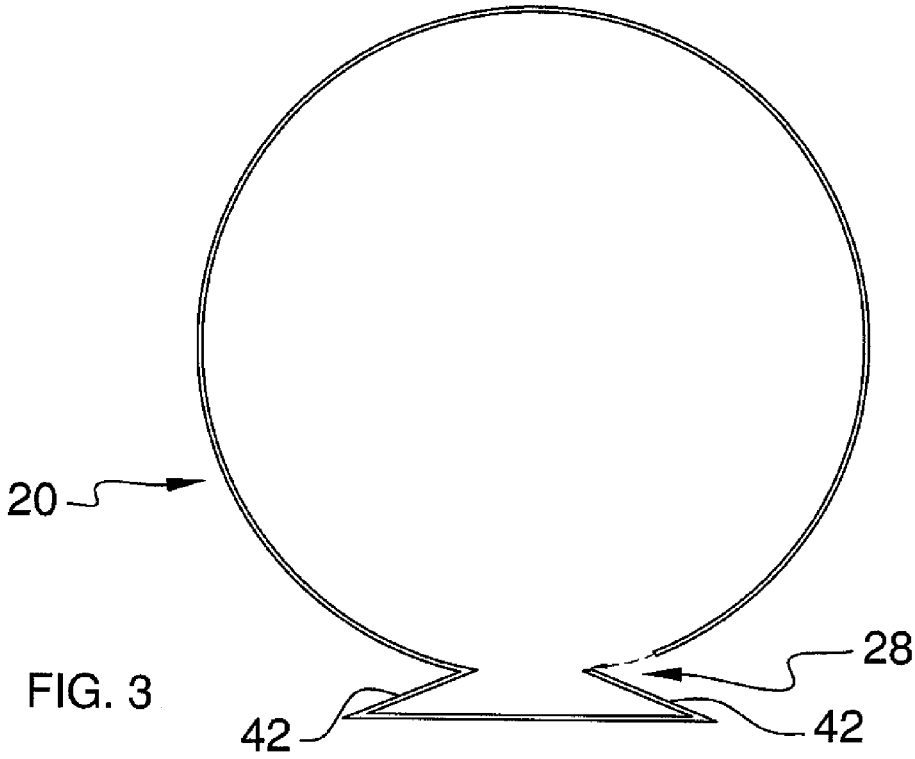
FIG. 3
FIG. 4
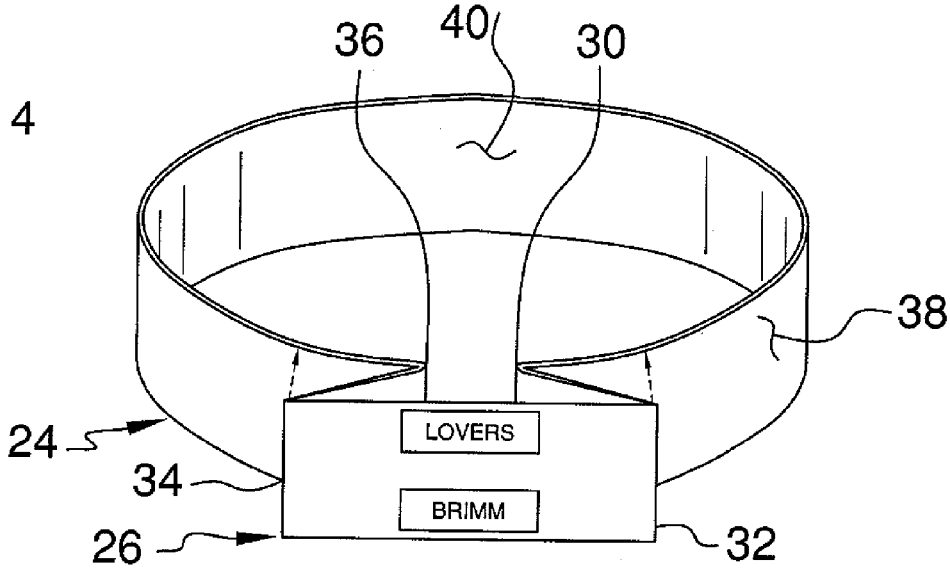

CAP

This application is a continuation in part of application Ser. No. 11/626,672 filed Jan. 24, 2007 now abandoned.

BACKGROUND OF THE INVENTION

1. Field of the Invention

The present invention relates to baseball caps and more particularly pertains to a new baseball cap for providing a distinctive appearance for a person.

2. Description of the Prior Art

The use of baseball caps is known in the prior art. While these devices fulfill their respective, particular objectives and requirements, the need remains for a device that has certain improved features that allows for a band to extend around the device and decorate the device. Additionally, the band should include a raised portion to receive decorative elements

SUMMARY OF THE INVENTION

The present invention meets the needs presented above by generally comprising a head cover that is positionable over a portion of a head of a person. The head cover is approximately hemi-spherical shaped. A bill is coupled to the head cover and extends outwardly from the head cover to shade eyes of the person. A band is removably positioned on an exterior surface of the head cover. The band is positioned adjacent and coextensive with the bottom edge of the head cover. The band includes a loop portion and a single raised section spaced from the exterior surface. The raised section is positioned adjacent to one of a pair of sides of the head cover. The band extends upwardly from the bottom edge of the head cover and above the bill. The raised section is adjustable to adjust a size of the loop portion to frictionally engage the exterior surface of the head cover. At least one decorative item is insertable through the raised section.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top view of a band of the present invention.

FIG. 4 is a front perspective view of the band of the present invention.

DESCRIPTION OF THE PREFERRED EMBODIMENT

Figure 1:
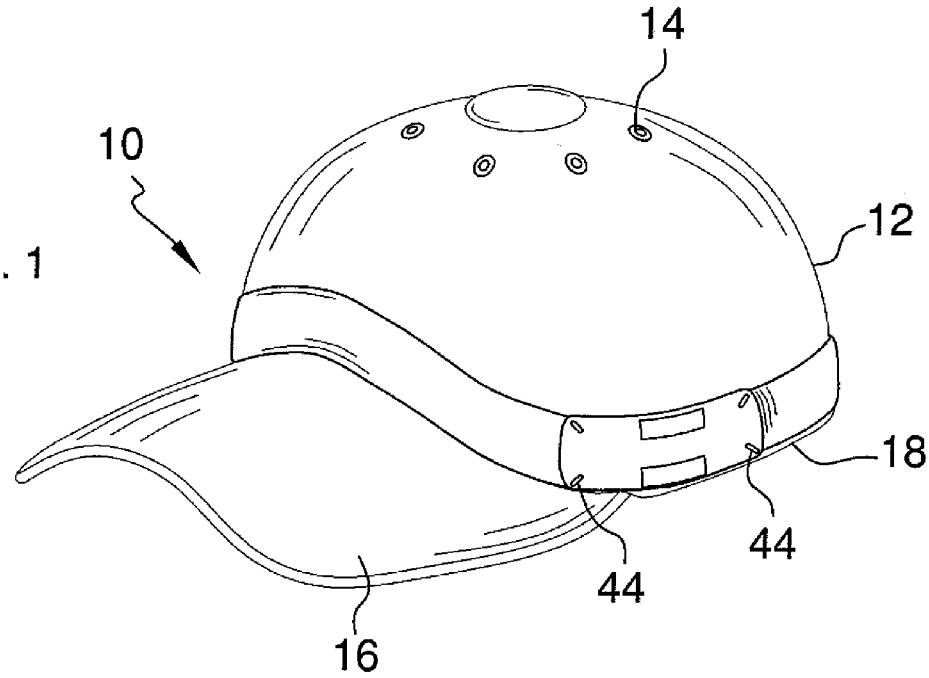
FIG. 1 is a front perspective view of a cap according to the present invention.
Figure 2:
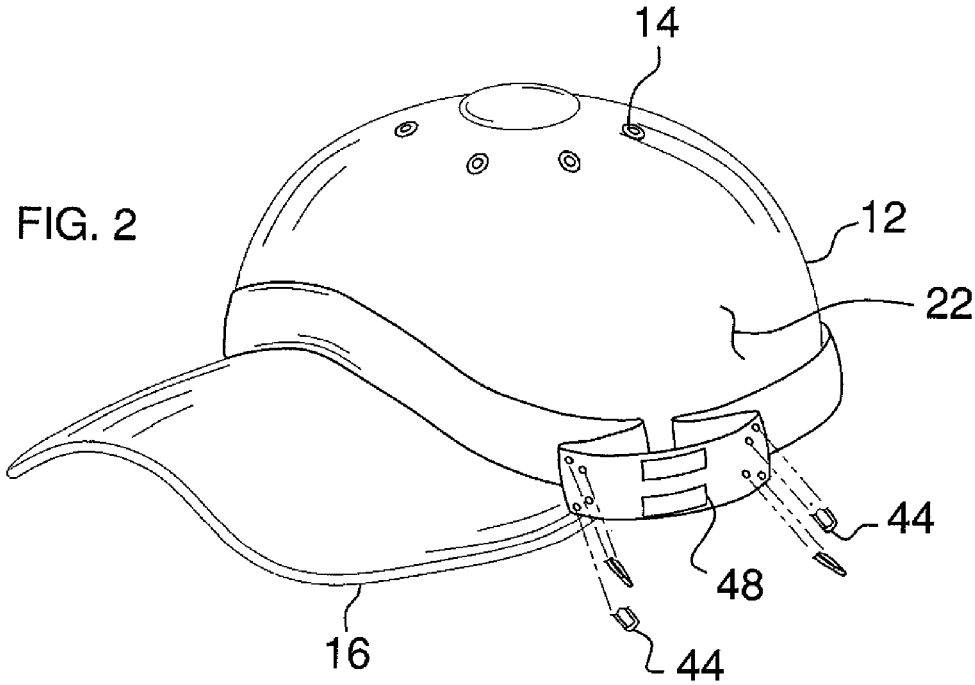
FIG. 2 is an expanded front perspective view of the present invention.

With reference now to the drawings, and in particular to FIGS. 1 through 7 thereof, a new cap device embodying the principles and concepts of the present invention and generally designated by the reference numeral 10 will be described.

As best illustrated in FIGS. 1 through 7, the cap 10 generally comprises a head cover 12 that is positionable over a portion of a head of a person. The head cover 12 is approximately hemi-spherical shaped and has a plurality of apertures 14 extending therethrough to facilitate ventilation when the head cover 12 is positioned on the head. The head cover 12 may include a conventional baseball cap. A bill 16 is coupled to the head cover 12 and extends outwardly from the head cover 12 to shade eyes of the person. The bill 16 is positioned adjacent a bottom edge 18 of the head cover 12 and only extends outwardly from a front of the head cover 12.

A band 20 is removably positioned on an exterior surface 22 of the head cover 12. The band 20 is positioned adjacent and coextensive with the bottom edge 18 of the head cover 12. The band 20 includes a loop portion 24 and a single raised section 26 spaced from the exterior surface 22. The raised section 26 is a bow that is positioned adjacent to one of a pair of sides of the head cover 12. The band 20 extends upwardly from the bottom edge 18 of the head cover 12 and above the bill 16 and has a width between approximately ⅞ of an inch and approximately 1 5/16 inches.

The raised section 26 is formed in the band 20 by a plurality of folds in the raised section 26 to adjust a size of the loop portion 24 to frictionally engage the exterior surface 22 of the head cover 12. This will allow the band 20 to be used with different hats as well as provide easy interchangeability of the bands with one hat. The band 20 may also include a break 28 therein, as shown in FIG. 3, for further adjustability of the band 20. The plurality of folds includes a first fold 30, a second fold 32 adjacent to the first fold 30, a third fold 34 adjacent to the second fold 32 and a fourth fold 36 adjacent to the third fold 34 wherein the third fold 34 is positioned between the second 32 and fourth folds 36. The first fold 30 may be formed by the joining of free ends of the band 20 formed by the break 28. The first 30 and fourth, 36 folds fold an outer surface 38 of the band 20 onto itself, while the second 32 and third 34 folds fold an inner surface 40 of the band 20 onto itself. Areas of the band 20 between the first 30 and second 32 folds and between the third 34 and fourth 36 folds define tabs 42 of the raised section 26.

Figure 5:
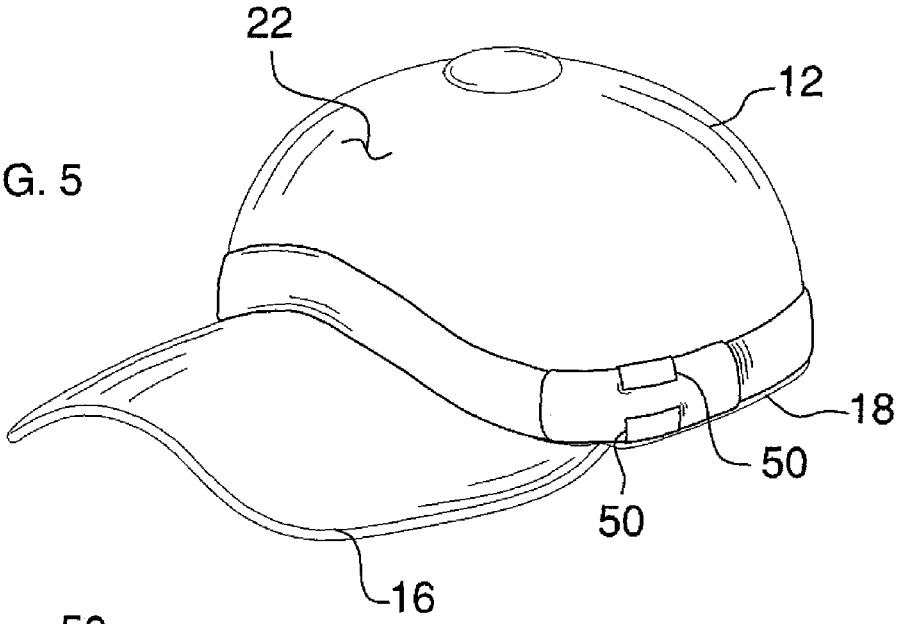
FIG. 5 is a front perspective view of the present invention using a second embodiment of securing members.
Figure 7:
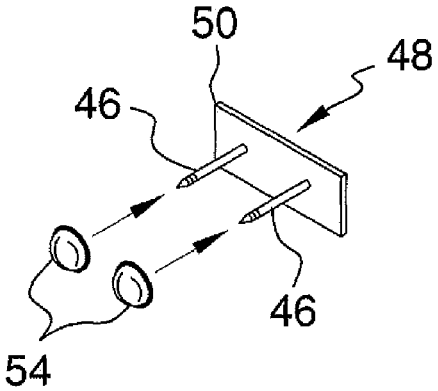
FIG. 7 is a rear perspective view of the second embodiment of the securing members of the present invention.
Figure 6:
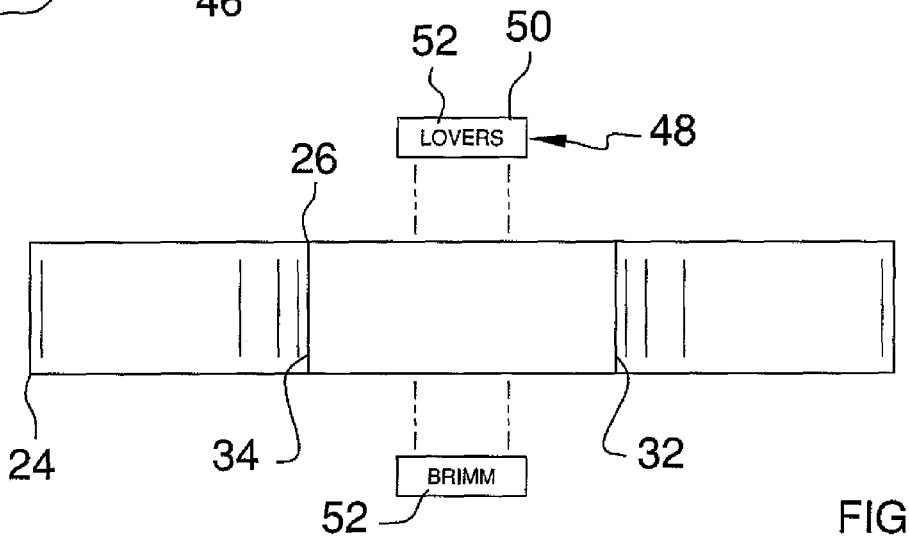
FIG. 6 is a front view of the band of the present invention using the second embodiment of securing members.

A plurality of securing members 44 extends through the tabs 42 and into the loop portion 24 to secure the raised section 26 in place with respect to the loop portion 24. The securing members 44 may be loops of thread. Alternatively, as shown in FIGS. 5-7, the securing members may be pins 46 positioned on each of a plurality of decorative items 48 that are insertable through the raised section 26. The securing members 44 or 46 secure the raised section 26 with respect to the loop portion 24. It should be understood that the one or more of the decorative items 48 may be used even if they are not being used as securing members. The decorative items 48 may be small plates 50 having indicia 52 thereon to either decorate the head cover 12 or to display a message. The pins 46 may include couplers 54 to prevent the pins 46 from falling out of the band 20.

In use, at least one decorative item 48 is placed on the raised section of the band 12. The head cover 12 is positioned over the head of the person. The band 20 and the at least one decorative item 48 provide a distinctive and easily alternated appearance to the head cover 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cap comprising:

a head cover being positionable over a portion of a head of a person, said head cover being approximately hemispherical shaped;

a bill being coupled to said head cover and extending outwardly from said head cover to shade eyes of the person;

a band being removably positioned on an exterior surface of said head cover, said band being positioned adjacent and coextensive with said bottom edge of said head cover, said band including a loop portion and a single raised section spaced from said exterior surface, said raised section being positioned adjacent to one of a pair of sides of said head cover, said band extending upwardly from said bottom edge of said head cover and above said bill, said raised section being adjustable to adjust a size of said loop portion to frictionally engage said exterior surface of said head cover, said raised section being formed in said band by a plurality of folds in said raised section, said plurality of folds including a first fold, a second fold adjacent to said first fold, a third fold adjacent to said second fold and a fourth fold adjacent to said third fold wherein said third fold is positioned between said second and fourth folds, said first and fourth folds folding an outer surface of said band onto itself, said second and third folds folding an inner surface of said band onto itself; and at least one decorative item being insertable through said raised section.

2. The cap according to claim 1, wherein said head cover has a plurality of apertures extending therethrough to facilitate ventilation when said head cover is positioned on the head.

3. The cap according to claim 2, wherein said bill being positioned adjacent a bottom edge of said head cover, said bill only extending outwardly from a front of said head cover.

4. The cap according to claim 1, wherein areas of said band between said first and second folds and between said third and fourth folds define tabs of said raised section, a plurality of securing members extending through said tabs and into said loop portion to secure said raised section in place with respect to said loop portion.

5. The cap according to claim 4, wherein said at least one decorative item includes at least one of said securing members to secure said raised section with respect to said loop portion.

6. The cap according to claim 1, wherein said band has a width between approximately 7/8 of an inch and approximately 1 5/16 inches.

7. A cap comprising:

a head cover being positionable over a portion of a head of a person, said head cover being approximately hemispherical shaped, said head cover having a plurality of apertures extending therethrough to facilitate ventilation when said head cover is positioned on the head;

a bill being coupled to said head cover and extending outwardly from said head cover to shade eyes of the person, said bill being positioned adjacent a bottom edge of said head cover, said bill extending outwardly from a front of said head cover;

a band being removably positioned on an exterior surface of said head cover, said band being positioned adjacent and coextensive with said bottom edge of said head cover, said band including a loop portion and a single raised section spaced from said exterior surface, said raised section being positioned adjacent to one of a pair of sides of said head cover, said band extending upwardly from said bottom edge of said head cover and above said bill;

said raised section being formed in said band by a plurality of folds in said raised section to adjust a size of said loop portion to frictionally engage said exterior surface of said head cover, said plurality of folds including a first fold, a second fold adjacent to said first fold, a third fold adjacent to said second fold and a fourth fold adjacent to said third fold wherein said third fold is positioned between said second and fourth folds, said first and fourth folds folding an outer surface of said band onto itself, said second and third folds folding an inner surface of said band onto itself, areas of said band between said first and second folds and between said third and fourth folds defining tabs of said raised section, a plurality of securing members extending through said tabs and into said loop portion to secure said raised section in place with respect to said loop portion;

said band having a width between approximately 7/8 of an inch and approximately 1 5/16 inches; and a plurality of decorative items being insertable through said raised section, each of said decorative items including one of said securing members to secure said raised section with respect to said loop portion.

* * * * *